US005980338A

United States Patent [19]

Le Pottier et al.

[11] Patent Number: 5,980,338

[45] Date of Patent: Nov. 9, 1999

[54] LOW PROFILE FEMALE TERMINAL FOR MATING TO A POST-LIKE MALE TERMINAL

[75] Inventors: Yves Le Pottier, Geneva; Bruce F. Smith, Plainfield, both of Ill.

[73] Assignee: Molex Incorporated, Lisle, Ill.

[21] Appl. No.: 08/911,964

[22] Filed: Aug. 15, 1997

[51] Int. Cl.[6] ..... H01R 4/48

[52] U.S. Cl. ..... 439/859; 439/839

[58] Field of Search ..... 439/859, 839, 439/842, 843, 851, 854, 855, 856, 857, 860, 881, 909, 522

[56] References Cited

U.S. PATENT DOCUMENTS 4,734,064 3/1988 Knapp et al. ..... 439/852

5,713,767 2/1998 Hanson et al. ..... 439/853

5,735,716 4/1998 Bilezikjian ..... 439/843

5,833,500 11/1998 Mahon et al. ..... 439/852

*Primary Examiner*—Paula Bradley

*Assistant Examiner*—Tho D. Ta

*Attorney, Agent, or Firm*—Stacey E. Caldwell

[57] ABSTRACT

A one-piece female terminal is provided for interconnection to a post-like male terminal. The female terminal includes a base portion, and a plurality of inwardly curved contact beams integral with and extending from the base portion and defining an interior socket for receiving the male terminal. A plurality of shell fingers are integral with and extend from the base portion exteriorly of the contact beams to provide protection for the beams.

17 Claims, 5 Drawing Sheets

LOW PROFILE FEMALE TERMINAL FOR MATING TO A POST-LIKE MALE TERMINAL

FEMALE TERMINAL

1. Field of the Invention

This invention generally relates to the art of electrical connectors and, particularly, to a one-piece female terminal for interconnection to a post-like male terminal.

2. Background of the Invention

Electrical connector assemblies are used for a wide variety of applications wherein it is desirable to interconnect an electrical device with an electrical power source. Male and female or plug and socket connectors often are used, and the connectors, themselves, employ male and female conductive terminals.

One type of electrical terminal assembly is used for electrically connecting an electrical power source with heating conductors incorporated or embedded in glass sheets, such as in rear window defrosters of automobiles or other vehicles. Specifically, the glass sheets used in the rear windows of vehicles often are heated electrically in order to eliminate or avoid fogging or frosting. Resistance conductors are incorporated or embedded on or in the glass sheet itself. Electric current is supplied to the heating resistance conductors by terminal assemblies which include a glass terminal applied generally to a conductive pad on the glass sheet. A mating harness terminal is electrically coupled to a lead line to the power source. Typically, the glass terminal is a male or plug terminal, and the harness terminal coupled to the lead line is a female or receptacle terminal.

Various problems are encountered in fabricating and using electrical terminal assemblies of the character described, particularly in use with vehicular rear window defroster applications. Known male and female terminals used in such applications of the blade and receptacle type are typically high profile, that is, they extend a relatively good distance from the surface of the window, and therefore can be easily hit and, due to their height, knocked off the window. Applying the glass terminal to the window is also a source of varying problems. It also would be desirable to provide a glass terminal which is "omni-directional" in which the harness terminal can be secured to the glass terminal in any direction. Protecting the harness terminal, particularly the contacts thereof, during shipping, handling and assembly also is a constant source of problems. It also is desirable to provide the terminals, particularly the harness terminal, with a low profile, yet providing contact beams which will provide high contact forces and experience low stress relaxation. The present invention is directed to solving these problems and satisfying the various needs described above.

SUMMARY OF THE INVENTION

An object, therefore, of the invention is to provide a new and improved female terminal for interconnection to a post-like male terminal, such as a male glass terminal for use with an electrically heated glass sheet.

In the exemplary embodiment of the invention, the one-piece female terminal includes a base portion, and a plurality of inwardly curved contact beams integral with and extending from the base portion. The beams define an interior socket for receiving the male terminal. A shell is integral with and extends from the base portion exteriorly of the contact beams to provide anti-overstress protection for the beams during unmating and to increase the retention force of the female terminal.

As disclosed herein, the socket defined by the inwardly curved contact beams defines a mating axis. The base portion comprises a generally planar wall generally perpendicular to the axis. At least three of the inwardly curved contact beams are spaced equidistant circumferentially about the axis. Each of the beams is curved in a substantially circular loop.

The shell is formed by a plurality of shell fingers integral with and extending from the planar base portion. The shell fingers and the inwardly curved contact beams alternate circumferentially about the interior socket defined by the beams. At least some of the shell fingers have laterally projecting portions disposed outside the contact beams to protect the beams. At least some of the shell fingers have inwardly turned distal ends defining an entrance to the interior socket. The distal ends of the fingers have arcuate edges which combine to define a circular configuration for the entrance to the interior socket. Finally, the shell fingers including portions juxtaposed with the inwardly curved contact beams to provide an anti-overstress means for the beams.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
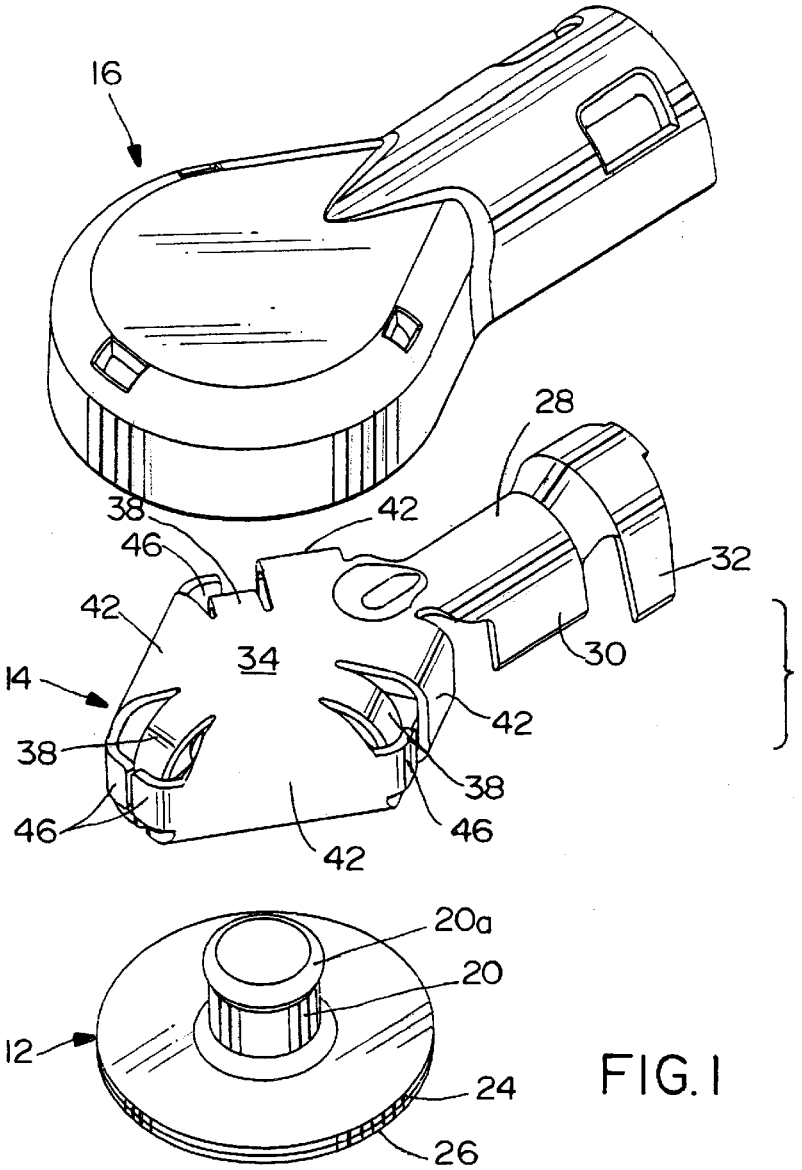
FIG. 1 is an exploded perspective view of an electrical terminal assembly incorporating the glass terminal and the harness terminal of the invention.
Figure 2:
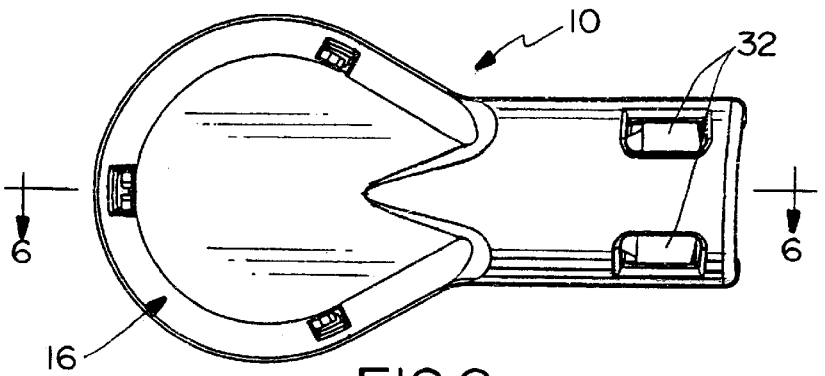
FIG. 2 is a top plan view of the terminal assembly.
Figure 3:
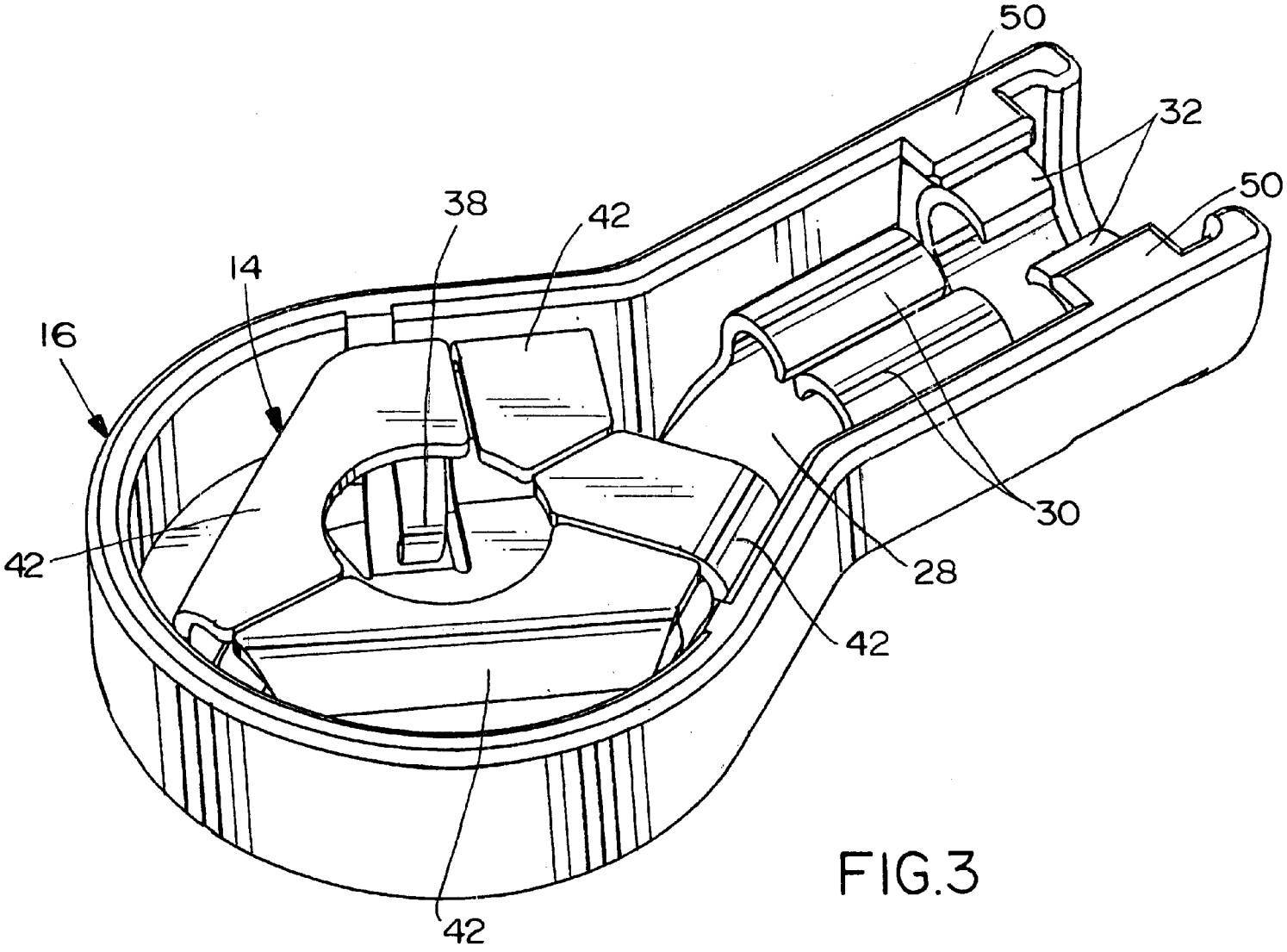
FIG. 3 is a bottom perspective view of the assembly, with the glass terminal removed.

Referring to the drawings in greater detail, and first to FIGS. 1–3, the invention is embodied in an electrical terminal assembly, generally designated 10 (FIG. 1), specifically applicable for use with an electrically heated glass sheet, such as a rear window defroster system in an automobile or other vehicle. Generally, the terminal assembly includes a glass terminal, generally designated 12, adapted for applying to the glass sheet of the rear window; a harness terminal, generally designated 14, for securing to a lead line from a power source of the vehicle; and a dielectric cover or boot, generally designated 16, which is snap fit over harness terminal 14.

Figure 6:
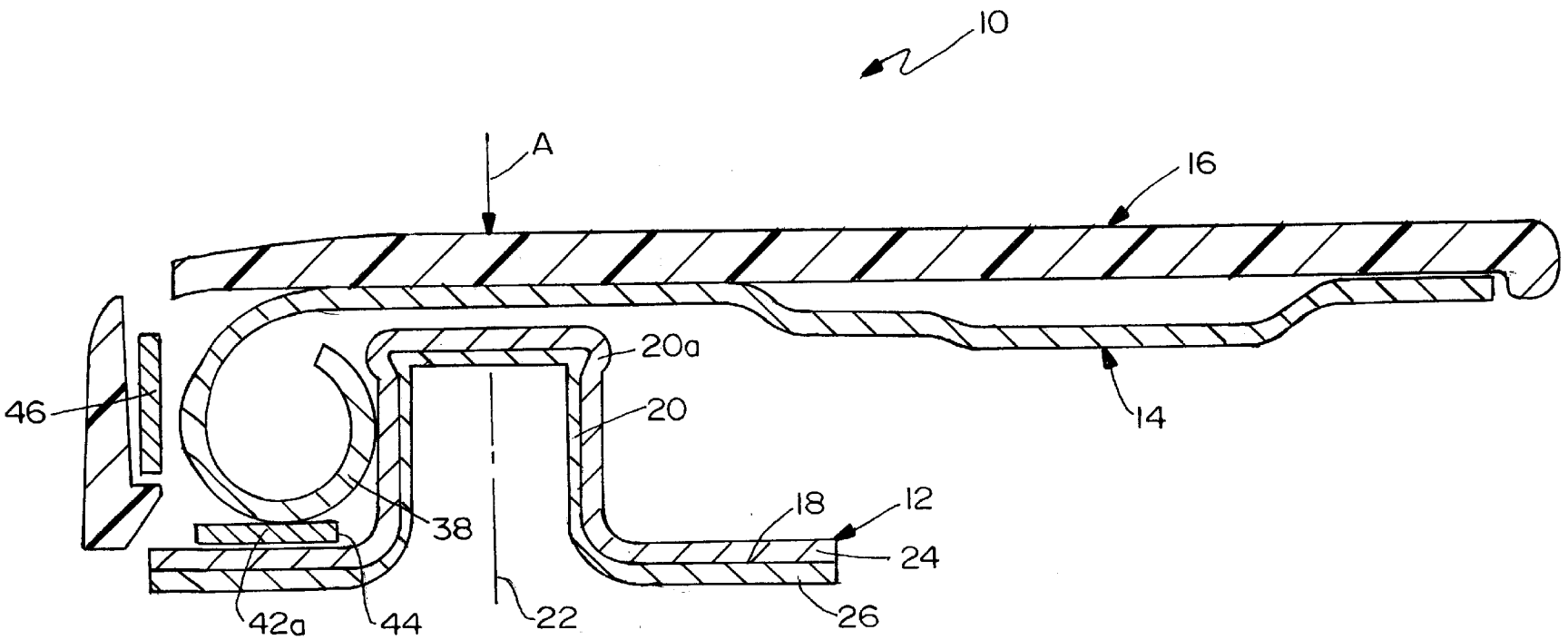
FIG. 6 is a vertical section taken generally along line 6—6 of FIG. 2.

More particularly, referring to FIG. 6 in conjunction with FIG. 1, glass terminal 12 is a one-piece laminated structure which includes a base plate portion 18 and an integral upstanding terminal post portion 20. The base plate portion is planar and circular and defines a central axis 22 (FIG. 6) perpendicular to the base plate portion. Terminal post portion 20 is cylindrical and concentric with axis 22. The terminal post portion has an enlarged head 20*a*.

Glass terminal 12 is a laminated structure and includes a relatively rigid base conductor layer 24 on the top side thereof and a solder layer 26 on the bottom side thereof. Base conductor layer 24 may be fabricated of a copper alloy, for instance. Solder layer 26 may be fabricated of an appropriate reflowable solder material.

With the unique structure of glass terminal 12 described above, the glass terminal can be connected to a conductive pad on the glass sheet of the vehicle rear window by a spin-soldering process. In other words, terminal post portion 20 of the glass terminal can be gripped by a spinning fixture as base plate portion 18 is maintained in contact with the conductive pad on the glass sheet. Specifically, solder layer 26 at the bottom of the base plate portion is maintained in contact with the conductive pad on the glass sheet. The terminal is rotated in a spinning fashion at a rapid speed about axis 22 whereupon the terminal is soldered to the conductive pad by the friction involved in the spin soldering process.

Figure 4:
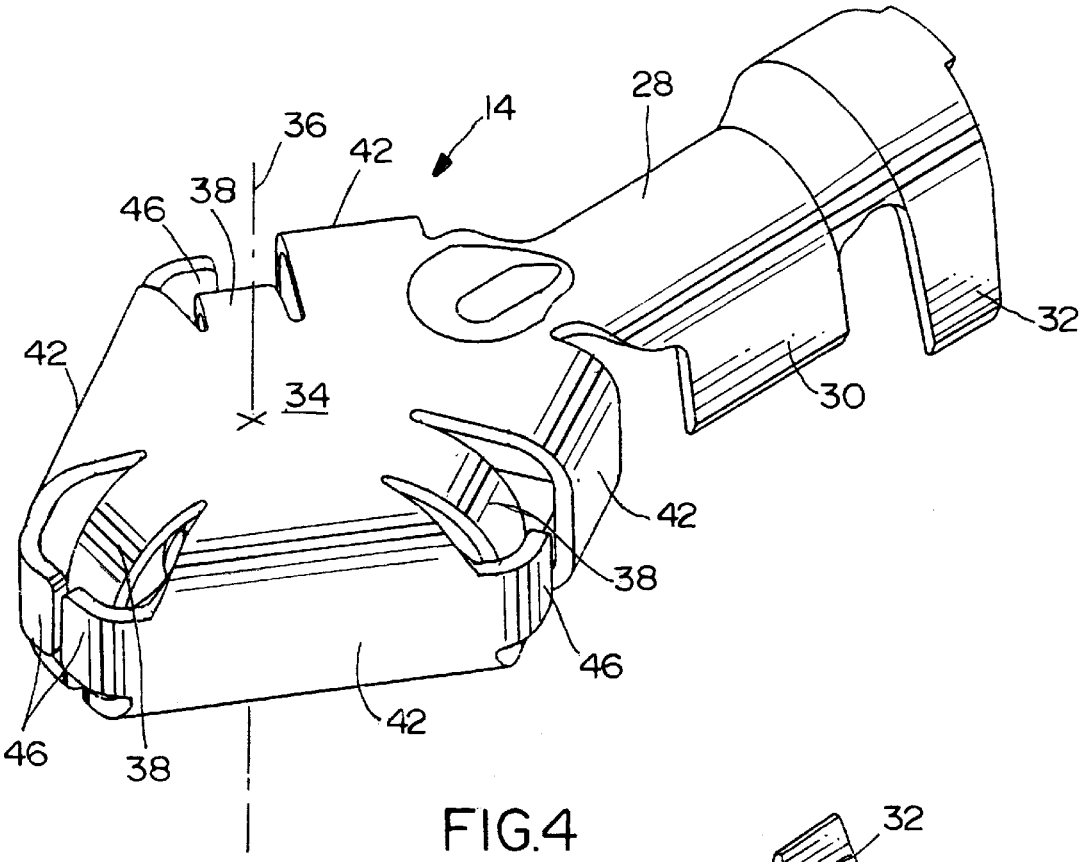
FIG. 4 is a top perspective view of the harness terminal.
Figure 5:
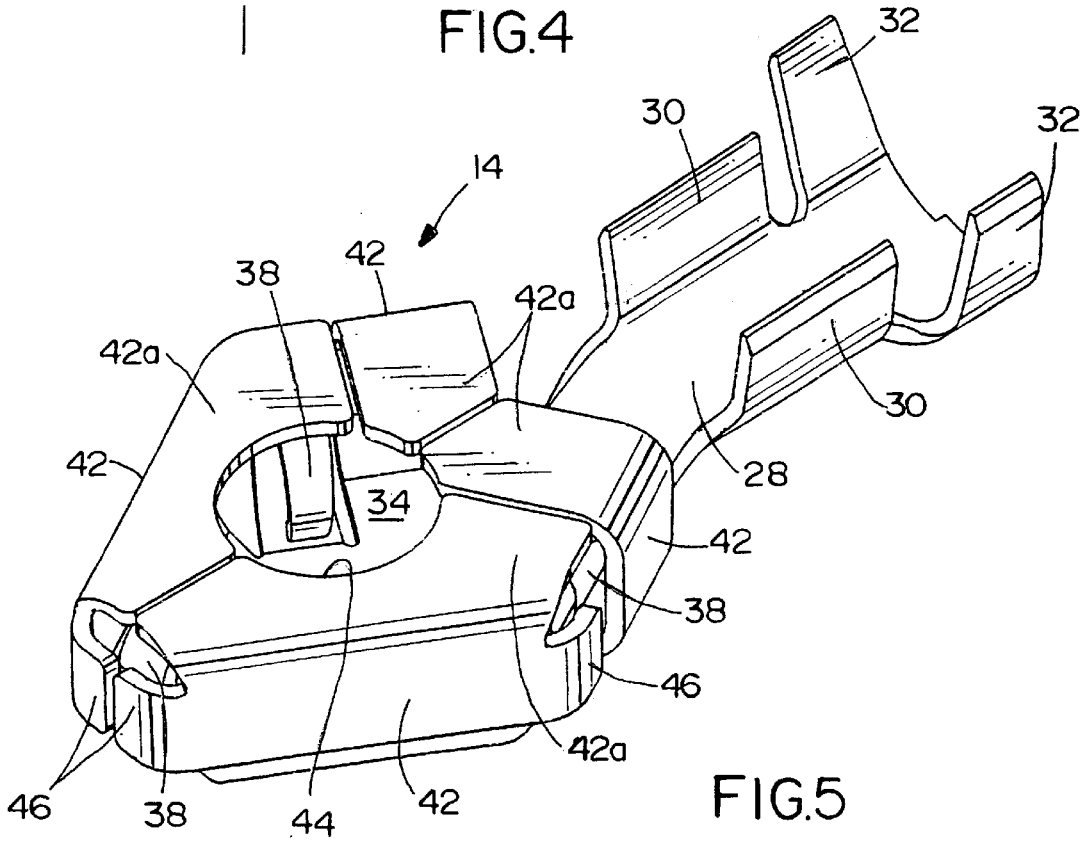
FIG. 5 is a bottom perspective view of the harness terminal.
Figure 7:
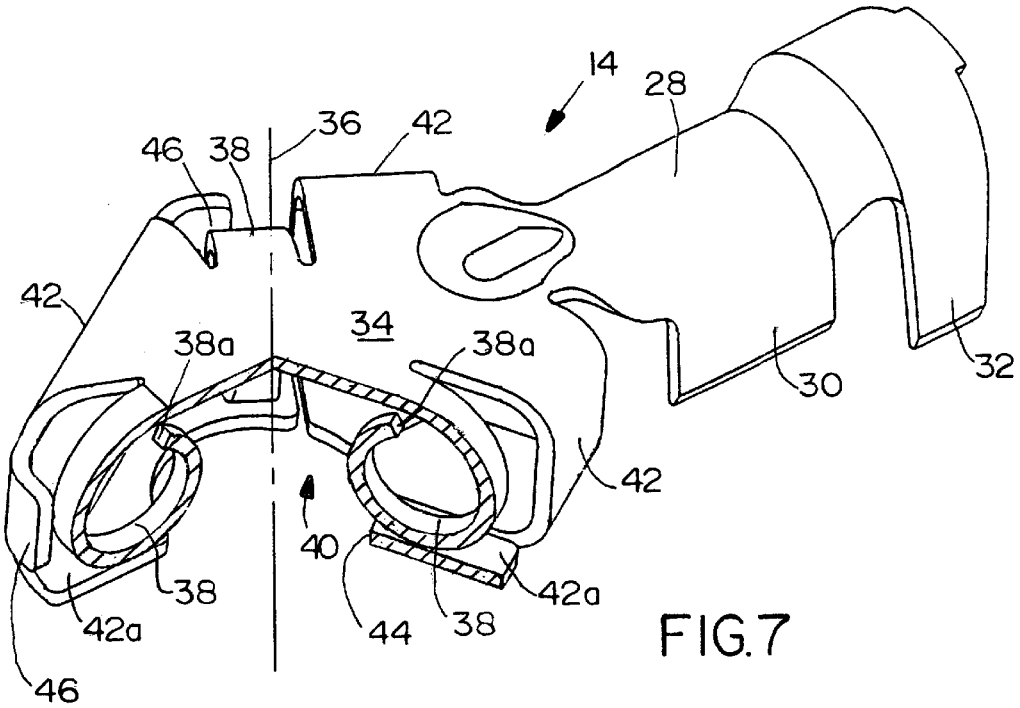
FIG. 7 is a top perspective view, partially cutaway, of the harness terminal.

Referring to FIGS. 4, 5 and 7 in conjunction with FIG. 1, harness terminal 14 is a one-piece terminal stamped and formed of conductive sheet metal material. The harness terminal is adapted for mating with glass terminal 12, and the harness terminal includes a crimp arm portion 28 for termination to an electrical lead from a power source, such as the power source of a vehicle. The lead typically is an insulated electrical wire or cable. Arm 28 has a first pair of crimping portions 30 for clamping on to the conductive core of the lead wire, and a second pair of crimping portions 32 for clamping onto the outer insulation of the lead wire to provide a strain relief means.

More particularly, harness terminal 14 includes a base portion 34 which is generally planar and perpendicular to a mating axis 36 which, when the harness terminal is mated with glass terminal 12, is coincident with central axis 22 (FIG. 6) of the glass terminal. A plurality of inwardly curved contact beams 38 are integral with and extend from base portion 34 and define an interior socket, generally designated 40 (FIG. 7), for receiving terminal post portion 20 of glass terminal 12. Contact beams 38 are spaced equidistant, circumferentially about axis 36. As best seen in FIG. 7, inwardly curved contact beams 38 are curved in a substantial circular loop and terminate in distal ends 38*a* juxtaposed beneath and slightly spaced from the underside of planar base portion 34.

Generally, harness terminal 14 includes a shell integral with and extending from base portion 34 exteriorly of contact beams 38 to provide protection for the beams. Specifically, the shell is provided by a plurality of shell fingers 42 spaced circumferentially about axis 36 of the harness terminal and between inwardly curved contact beams 38. Shell fingers 42 are formed or inwardly turned from base portion 34 around the bottom of the terminal and terminate in inwardly turned distal ends 42*a* which substantially close the bottom of the harness terminal except for a circular entrance 44 (FIG. 5) to interior socket 40 (FIG. 7). In particular, inwardly turned distal ends 42*a* of the shell fingers have arcuate edges as best seen in FIG. 5 which combine to define the circular configuration for entrance 44 to the interior socket of the terminal.

At least some of shell fingers 42, namely the two shell arms diametrically opposite crimp arm 28, are provided with laterally projecting portions 46 which are disposed outside contact beams 38 to protect the beams. This is particularly important during shipping, handling and assembly of the harness terminal which can be subjected to considerable abuse at various times prior to assembly to glass terminal 12.

As best seen in FIGS. 5 and 7, the inwardly turned distal ends 42*a* of the two shell fingers 42 diametrically opposite crimp arm 28 are disposed immediately beneath inwardly curved contact beams 38. Therefore, the distal ends of the shell fingers not only provide protection for the contact beams at the underside of the harness terminal, but the distal ends of the shell fingers also provide an anti-overstress means for the beams. In fabrication, contact beams 38 first are formed inwardly from base plate 34, and then shell fingers 42 are formed over the contact beams.

FIG. 3 best shows how dielectric cover 16 is mounted over harness terminal 14. Specifically, the cover includes a pair of inwardly directed flanges 50 which snap-fit over the pair of crimp portions 32 of crimp arm 28 of the harness terminal. Crimping portions 30 and 32 are shown in FIG. 3 in their crimped condition, but the lead wire is not shown in this depiction. Cover 16 is a one-piece structure unitarily molded of dielectric material such as plastic or the like. The cover has a very low profile matching the low profile of harness terminal 14.

Figure 8:
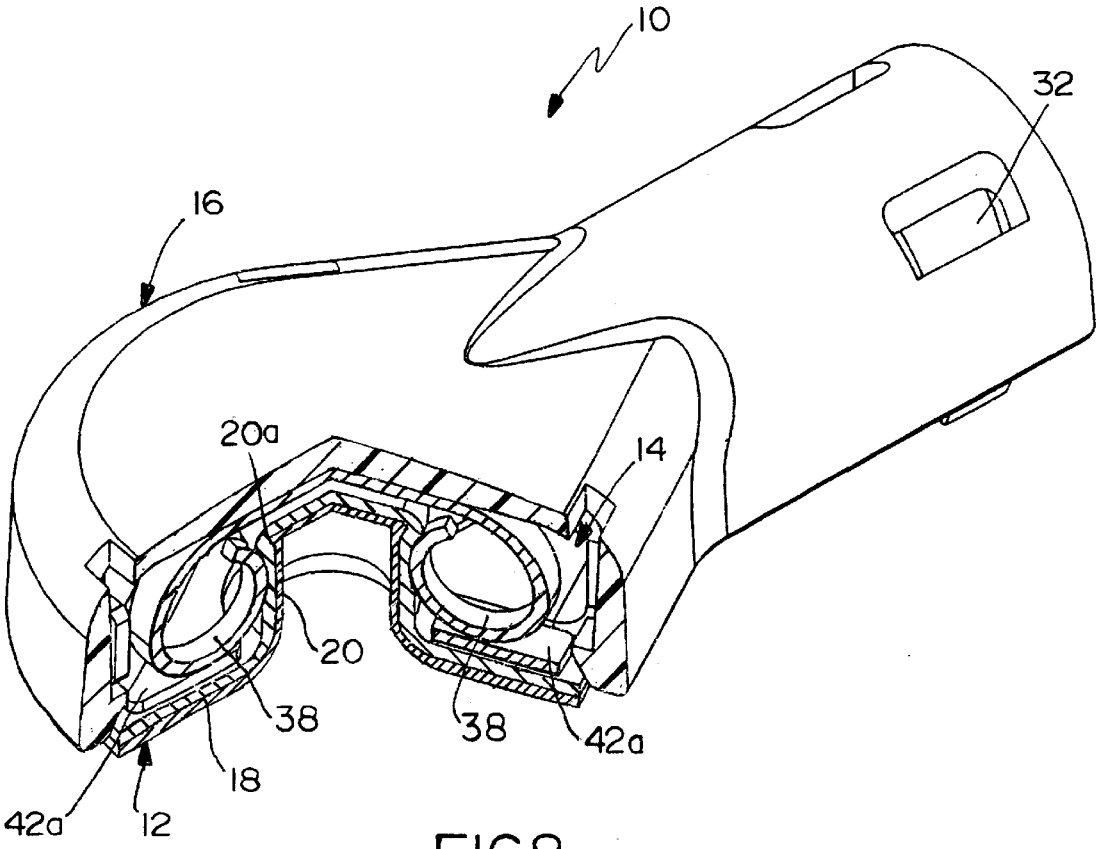
FIG. 8 is a top perspective view, partially cutaway, of the terminal assembly.

FIGS. 6 and 8 show terminal assembly 10 in mated or connected condition. In other words, harness terminal 14 is mated with glass terminal 12. The harness terminal is mated with the glass terminal in the direction of arrow "A" (FIG. 6). During mating, inwardly curved contact beams 38 flex radially outwardly when they engage the top of enlarged head 20*a* of terminal post 20 of the glass terminal. The contact beams then snap back inwardly behind the enlarged head of the terminal post in the mated condition of the terminal assembly as shown in FIGS. 6 and 8.

The terminal assembly, particularly harness terminal 14, of the invention has an extremely low profile as can be seen in the drawings. The circularly curved contact beams 38 reduce the beam profile and increase the total contact deflection the beams can undergo without taking excessive permanent set. This is particularly desirable since it provides a high contact force system with inherent low stress relaxation in the beams that are tolerant of significant contact interface dimensional variations. Since the contact beams can potentially be damaged during fabrication, shipping, handling and assembly, the outside shell provided by shell fingers 42 not only provides significant protection for the contact beams but also provides an anti-overstress means. All extraneous or additional components are eliminated by this one-piece stamped and formed structure. Glass terminal 12 further provides an extremely efficient and effective connector assembly by allowing the glass terminal to be secured to a conductive pad on the glass sheet by a spin soldering (friction) process.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A low profile female terminal for interconnection to a post-like male terminal, comprising:

a base portion; an arm portion extending from the base portion for clamping onto an insulated wire and at least three inwardly curved contact beams integral with and extending from the base portion and defining an interior socket for receiving the male terminal, the socket defining a mating axis generally perpendicular to the base portion such that the contact beams are spaced equidistant and circumferentially about the axis.

2. The low profile female terminal as set forth in claim 1 further comprising a one-piece dielectric cover for snappingly fitting around the base portion.

3. The one-piece female terminal of claim 1 wherein said base portion comprises a generally planar wall generally perpendicular to the mating axis.

4. The one-piece female terminal of claim 1 wherein each of said inwardly curved contact beams are curved in a substantially circular loop.

5. The low profile female terminal as set forth in claim 1 further comprising a shell integral with and extending from the base portion exteriorly of the contact beams to provide protection for the beams.

6. The one-piece female terminal of claim 5 wherein said shell comprises a plurality of shell fingers integral with and extending from the base portion.

7. The one-piece female terminal of claim 6 wherein said shell fingers and said inwardly curved contact beams alternate circumferentially about said interior socket.

8. The one-piece female terminal of claim 6 wherein at least some of said shell fingers have laterally projecting portions disposed outside the contact beams to protect the beams.

9. The one-piece female terminal of claim 6 wherein said shell fingers include portions juxtaposed with said inwardly curved contact beams to provide an anti-overstress means for the beams.

10. The one-piece female terminal of claim 6 wherein at least some of said shell fingers have inwardly turned distal ends defining an entrance to said interior socket.

11. The one-piece female terminal of claim 10 wherein said inwardly turned distal ends have arcuate edges which combine to define a circular configuration for said entrance to the interior socket.

12. A one-piece female terminal for interconnection to a post-like male terminal, comprising:

a generally planar base portion;

at least three inwardly curved contact beams integral with and extending from the planar base portion and defining an interior socket for receiving the male terminal, the socket defining a mating axis generally perpendicular to the planar base portion; and a shell formed by a plurality of shell fingers integral with and extending from the planar base portion between at least some of said inwardly curved contact beams, the shell fingers being disposed exteriorly of the contact beams to provide protection for the beams.

13. The one-piece female terminal of claim 12 wherein each of said inwardly curved contact beams are curved in a substantially circular loop.

14. The one-piece female terminal of claim 12 wherein at least some of said shell fingers have laterally projecting portions disposed outside the contact beams to protect the beams.

15. The one-piece female terminal of claim 12 wherein said shell fingers include portions juxtaposed with said inwardly curved contact beams to provide an anti-overstress means for the beams.

16. The one-piece female terminal of claim 12 wherein at least some of said shell fingers have inwardly turned distal ends defining an entrance to said interior socket.

17. The one-piece female terminal of claim 16 wherein said inwardly turned distal ends have arcuate edges which combine to define a circular configuration for said entrance to the interior socket.

* * * * *